US010029711B2

(12) United States Patent
Gibney et al.

(10) Patent No.: US 10,029,711 B2
(45) Date of Patent: Jul. 24, 2018

(54) SOLEBAR FOR A RAILWAY VEHICLE

(71) Applicant: Drax Power Limited, Selby, North Yorkshire (GB)

(72) Inventors: Richard Peter Gibney, Derby (GB); David Thomas Turner, Derby (GB); Paul Hodgkinson, Derby (GB)

(73) Assignee: Drax Power Limited, Selby, Yorkshire (GB)

( * ) Notice: Subject to any disclaimer, the term of this patent is extended or adjusted under 35 U.S.C. 154(b) by 243 days.

(21) Appl. No.: 14/768,583

(22) PCT Filed: Feb. 18, 2014

(86) PCT No.: PCT/GB2014/050468
§ 371 (c)(1),
(2) Date: Aug. 18, 2015

(87) PCT Pub. No.: WO2014/128447
PCT Pub. Date: Aug. 28, 2014

(65) Prior Publication Data

US 2016/0001794 A1 Jan. 7, 2016

(30) Foreign Application Priority Data

Feb. 19, 2013 (GB) ..... 1302872.5

(51) Int. Cl.
*B61F 1/14* (2006.01)
*B61F 1/08* (2006.01)

(52) U.S. Cl.
CPC . *B61F 1/14* (2013.01); *B61F 1/08* (2013.01)

(58) Field of Classification Search
CPC ..... B61F 1/08; B61F 1/14; B61F 1/00; B61F 1/02; B61D 17/10; B61D 17/04; B61D 17/00; B61D 17/043; B61D 17/045
USPC ..... 105/329.1, 415, 417, 413, 414, 418
See application file for complete search history.

(56) References Cited

U.S. PATENT DOCUMENTS 4,893,567 A * 1/1990 Hill ..... B61D 3/20 105/4.1
2002/0024235 A1* 2/2002 Campus ..... B61D 17/045 296/203.01

FOREIGN PATENT DOCUMENTS

JP 7-329777 * 12/1995
JP 9-273222 * 10/1997

* cited by examiner

*Primary Examiner* — Mark T Le
(74) *Attorney, Agent, or Firm* — Gesmer Updegrove LLP

(57) ABSTRACT

A solebar for a railway vehicle has an elongate body that comprises a first leg and a second leg, wherein the first leg and second are configured to meet at a vertex and have an obtuse angle θ therebetween such that the solebar has an obtuse L-shaped cross-sectional profile. The solebar is mounted as an underframe side member in a railway vehicle such that the first leg extends in a downwardly direction towards a floor supporting the railway vehicle and clears a lower sector of a loading gauge, and the second leg inclines upwardly in a direction away from railway vehicle and clears an upper sector of the loading gauge. The second leg is configured to support an upper sidewall of a body of the railway vehicle such that the upper sidewall clears the upper sector of the loading gauge.

30 Claims, 10 Drawing Sheets

SOLEBAR FOR A RAILWAY VEHICLE

PRIORITY INFORMATION

The present invention is a continuation of PCT Application No. PCT/GB2014/050468 filed Feb. 18, 2014, that claims priority to GB Application No. 1302872.5, filed on Feb. 19, 2013, both of which are incorporated herein by reference in their entireties.

FIELD OF INVENTION

This invention relates to a solebar for a railway vehicle.

BACKGROUND TO THE INVENTION

A railway vehicle comprises an underframe, a body supported by the underframe and at least two bogies coupled to the underside of the underframe.

A solebar (sometimes referred to as a sole bar, sole-bar or side sill) is a longitudinal structural member of the underframe. Conventional solebars have a box or channel-shaped cross-sectional profile.

As shown in FIG. 1, a conventional railway vehicle underframe is an oblong frame comprising a first solebar (1*a*), a second solebar (1*b*), a first headstock (2*a*) and a second headstock (2*b*). The first solebar (1*a*) and the second solebar (1*b*) extend lengthwise forming the longitudinal side members of the underframe. The first headstock (2*a*) and the second headstock (2*b*) extend crosswise between the ends of the solebars forming horizontal end members. In the underframe depicted in FIG. 1, the solebars have a channel shaped cross-sectional profile. The sidewalls of the railway vehicle body are mounted on the solebars. Hence, the design of the solebar influences the size, shape and volumetric capacity of the railway vehicle body. Buffers (3) and drawgear are mounted on the headstocks. Bogies are typically coupled to the underside of the underframe using bolster members (4). Further cross-members (5) may extend between the solebars and/or the headstocks to improve the structural integrity of the underframe.

So as to ensure safe passage of the railway vehicle along a railway track, across bridges, through tunnels, via other railway structures and past other railway vehicles etc. the design of a railway vehicle must comply with the loading gauge. The loading gauge defines the maximum permissible railway vehicle dimensions, certain suspension displacements and certain curve overthrow limitations for the railway route. A loading gauge has an upper sector and a lower sector. The lower sector loading gauge is the area up to and including a predetermined height above the rails. The height may be determined by the height of the railway platform. For example, the standard lower sector for freight vehicle gauges in the UK is the area up to and including 1000 mm above the plane of the rails. The profile of the upper sector loading gauge is typically stepped or offset from the profile of lower sector loading gauge. As a result, the upper sector loading gauge has an outdented profile relative to the lower sector loading gauge.

To help ensure the railway vehicle has loading gauge clearance, the solebars of a railway vehicle must be configured to fit within the loading gauge.

Whilst conventional solebar designs are able to achieve a sufficient loading gauge clearance, it is understood that, due to the configuration and position of the conventional solebars, the mounting and subsequent arrangement of the body sidewalls on the solebars is restricted and so the shape, size and volumetric capacity of the railway vehicle body is constrained (limited, compromised). For example, FIG. 2 depicts a partial end view of a conventional railway vehicle with the underframe depicted in FIG. 1. It can be seen in FIG. 2 how the channel shaped solebars (only 1*b* shown) are configured as longitudinal side members of the underframe such that they are arranged within the lower sector loading gauge (LOWER SECTOR) of the railway vehicle. Hence, the underframe of the conventional railway vehicle has loading gauge clearance in the lower sector. Due to the channel shaped cross-sectional profile of the solebars, each sidewall (only 6*b* shown) of the conventional railway vehicle body is mounted on the solebars such that a mounting portion is coupled to the inner surface (IN1) of the respective solebar, an inclined portion inclines in an upwardly direction within the upper sector loading gauge (UPPER SECTOR) from the inner top edge of the solebar until it is close to the upper sector loading gauge boundary and then an upright portion extends in a generally upwards direction. The interior volume of the underframe is determined by the distance between the inner surfaces of the solebars which, as shown in FIG. 2, is confined by the cross-sectional width of the solebars. The shape of the railway vehicle body is influenced by the mounting arrangement of the sidewalls and cross-sectional width of the solebar. The size and subsequently the volumetric capacity of the railway vehicle body are determined by the distance between the opposing sidewalls of the railway vehicle body, which in turn is governed by the mounting arrangement of the sidewalls and the cross-sectional width of the solebar. It can be seen in FIG. 2, that due to the mounting arrangement of the sidewalls and the cross-sectional width of the solebars, the inclined portions of the sidewalls do not comply closely (correspond, match) with the profile of the upper sector loading gauge as they extend from the solebar. Moreover, the gap space between the inclined sidewalls and the upper sector loading gauge is substantially greater than is necessary to achieve loading gauge clearance. Hence, although loading gauge clearance of the railway vehicle body is achieved, the shape, size and volumetric capacity of the conventional railway vehicle body are restricted.

SUMMARY OF THE INVENTION

The present invention seeks to provide a solebar with an improved and alternative design. The present invention seeks to address or at least substantially counteract the problems associated with conventional solebars as described above. Accordingly, embodiments of the invention seek to provide a solebar that improves the size, shape and/or volumetric capacity of a railway vehicle whilst achieving loading gauge clearance.

The present invention is defined in the attached independent claims, to which reference should now be made. Further preferred features may be found in the sub claims appended thereto.

A first aspect of the invention relates to a solebar for a railway vehicle that has an elongate body with an obtuse L-shaped cross-sectional profile.

The elongate body of the solebar comprises a first leg and a second leg, whereby the first leg and the second leg are configured to meet at a vertex and have an obtuse angle θ therebetween such that the solebar has an obtuse L-shaped cross-sectional profile. The vertex preferably extends at least substantially along the length of the elongate body.

Due to the obtuse L-shaped cross-sectional profile of the solebar, the solebar can be mounted as an underframe side member in a railway vehicle, such that the first leg extends in a downwardly direction towards a floor supporting the railway vehicle and clears a lower sector loading gauge and the second leg extends upwardly at an incline in a direction away from the railway vehicle and clears an upper sector loading gauge.

The first leg preferably extends parallel to the profile of the lower sector loading gauge. The second leg preferably extends at an incline towards the upper sector loading gauge, across a stepped portion of the loading gauge between the lower sector loading gauge and the upper sector loading gauge. As a result, the solebar advantageously compliments the stepped profile of a lower sector and an upper sector of a railway vehicle loading gauge. Thus, the solebar achieves loading gauge clearance and the interior volume of the underframe is optimised.

The solebar is configured to support the sidewalls of the railway vehicle body. Due to the obtuse L-shaped cross-sectional profile of the solebar, the solebar is able to support the sidewalls such that the shape, size and/or volumetric capacity of the railway vehicle body is enhanced in addition to achieving loading gauge clearance.

The second leg of the solebar may be configured to support an upper sidewall of the body. Due to the configuration of the second leg in the upper sector loading gauge, the solebar provides an improved mounting arrangement for the upper sidewall. The first leg of the solebar may be configured to support a lower sidewall of the body. Due to the configuration of the first leg in the lower sector loading gauge, the solebar provides an improved mounting arrangement for the lower sidewall.

The mounting arrangement provided by the solebar according to the present invention is superior to that provided by a conventional solebar because, in addition to providing a supporting effect on the sidewalls, it enhances the conformance of the sidewalls with the profile of the loading gauge, improves the size and volumetric capacity of the railway vehicle body and provides a more continuous and streamline railway vehicle body shape.

The obtuse angle θ of the solebar may be selected from a range of approximately 105° to 165°. The obtuse angle θ is preferably selected to optimise the conformance of the legs and sidewalls with the profile of the loading gauge, enhance the shape of the railway body and/or improve the volumetric capacity of the railway body. If the railway vehicle is a hopper wagon vehicle for bulk commodities the obtuse angle θ is preferably selected in accordance with the flow characteristics of the bulk commodities so that the inclination of the inclined upper sidewalls portions aids the flow of the bulk commodities towards an outlet.

The solebar may be a one piece unit.

Alternatively, the solebar may comprise multiple solebar sections coupled together. Preferably each of the solebar sections comprises a first leg section and a second leg section that are configured such that each solebar section has the same obtuse L-shape cross-sectional profile. The multiple solebar sections may be coupled together forming cross-sectional junctions. The multiple solebar sections may be coupled together using coupling means and/or a welding process. The cross-sectional edges of the solebar may be tapered to improve the weld.

The solebar may comprise a first end region, a central region and a second end region. If the solebar is formed from multiple sections, then the first end region may be formed by a first end section, the central region may be formed by one or more central sections and the second end region may be formed by a second end section.

So as to form an underframe side member, at least a portion of the first leg at the first end section of the solebar is configured to be coupled to a first headstock and at least a portion of the first leg at the second end section is configured to be coupled to a second headstock. The portions of the first leg may be coupled to the headstocks using coupling means and/or a welding process. The side edges of first leg may be tapered to improve the weld.

The first end region and/or the second end region of the solebar are configured to taper inwardly by angle β with respect to a longitudinal axis of the solebar. Since the sidewalls of the railway body are mounted on the solebar, the end regions/corners of the body will taper inwardly due to the taper of the solebar. The tapering of the end regions of the solebar advantageously helps to maintain the gauge clearance of the underframe and railway body as the railway vehicle travels along a curved section of track. The taper angle β may be selected from a range of approximately 2° to 4°.

The first end region and/or second end region of the solebar may comprise an indent. The indent may be configured such that the solebar can be fitted to extend around other component parts of the railway vehicle.

The first leg may have a longer longitudinal length than the second leg in the first end region and/or the second end region of the solebar. Hence, the first leg protrudes longitudinally beyond the end of the second leg and the solebar has a stepped longitudinal profile.

The first leg in the first end region and/or the second end region may have a longer transverse length than the first leg in the central region of the solebar. Hence, the solebar has a stepped transverse profile.

The solebar may further comprise an infill section that is configured to infill at least a portion of a transverse step recess that is formed by the stepped transverse profile of the first leg. The infill section thereby improves the structural rigidity of the solebar.

The solebar is suitable for use in any type of railway vehicle. For example, the solebar may form an underframe side member in a locomotive, a passenger vehicle or a non-passenger vehicle.

A second aspect of the invention relates to an underframe of a railway vehicle comprising a first solebar according to the first aspect of the invention.

The underframe may further comprise a second solebar according to the first aspect of the invention, whereby the second solebar is arranged parallel to the first solebar.

A third aspect of the invention relates to a railway vehicle comprising a first solebar according to a first aspect of the invention that is arranged to form a first underframe side-member.

The railway vehicle has a loading gauge with a lower sector and an upper sector and the solebar is arranged such that the first leg is preferably configured to conform to the lower sector loading gauge and the second leg is preferably configured to conform to the upper sector loading gauge.

The solebar may be configured in the railway vehicle such that the first leg preferably extends generally downwardly towards the floor and/or the second leg preferably extends upwardly and outwardly from the railway vehicle at an obtuse angle from the first leg.

The railway vehicle may comprise an upper sidewall of the railway vehicle body mounted on the second leg of the solebar. The railway vehicle may comprise a lower sidewall of the railway vehicle body mounted on the first leg of the solebar.

The upper sidewall may be coupled to the second leg in an overlapping fashion, thereby forming an overlapping upper sidewall portion. The upper sidewall may extend from the second leg at the same angle of inclination as the second leg, thereby forming an inclined upper sidewall portion. The upper sidewall may then bend and extend in a generally upwardly direction forming an upright upper sidewall portion.

Likewise, a lower sidewall may be coupled to the first leg in an overlapping fashion, thereby forming an overlapping lower sidewall portion. The lower sidewall may extend from the first leg with the same profile as the first leg, thereby forming a parallel lower sidewall portion.

The railway vehicle may comprise a second solebar according to the first aspect of the invention arranged to form a second, opposing underframe side member.

BRIEF DESCRIPTION OF DRAWINGS

For a better understanding of the present invention and to show how it may be carried into effect, reference shall now be made by way of example to the accompanying drawings in which.

DETAILED DESCRIPTION OF THE INVENTION

Referring now to FIGS. 3 to 6*g*, the present invention relates to a solebar (10) for a railway vehicle. The solebar is configured to be a longitudinal structural member of an underframe of a railway vehicle.

The solebar is suitable for use in any type of railway vehicle. For example, the solebar is suitable for use in the underframe of a locomotive, a passenger vehicle or a non-passenger railway vehicle. The non-passenger railway vehicle may, for example, be a freight railway vehicle such as a hopper wagon.

The solebar has an elongate body with a length (L), width (W), height (H), first end region (E1), central region (C) and second end region (E2).

The elongate body comprises a first leg (11) and a second leg (12). The first leg and second leg meet at a vertex (13). The vertex is a junction, corner or bend in the elongate body and it extends at least substantially along the length of the body. The first leg and the second leg are inclined at the vertex such that the included angle between the first leg and the second leg is an obtuse angle θ. Hence, the solebar has an obtuse L-shaped cross-sectional profile.

Each leg of the solebar has a longitudinal length (LL11, LL12), a transverse length (TL11, TL12) and a depth (D11, D12).

Figure 1:
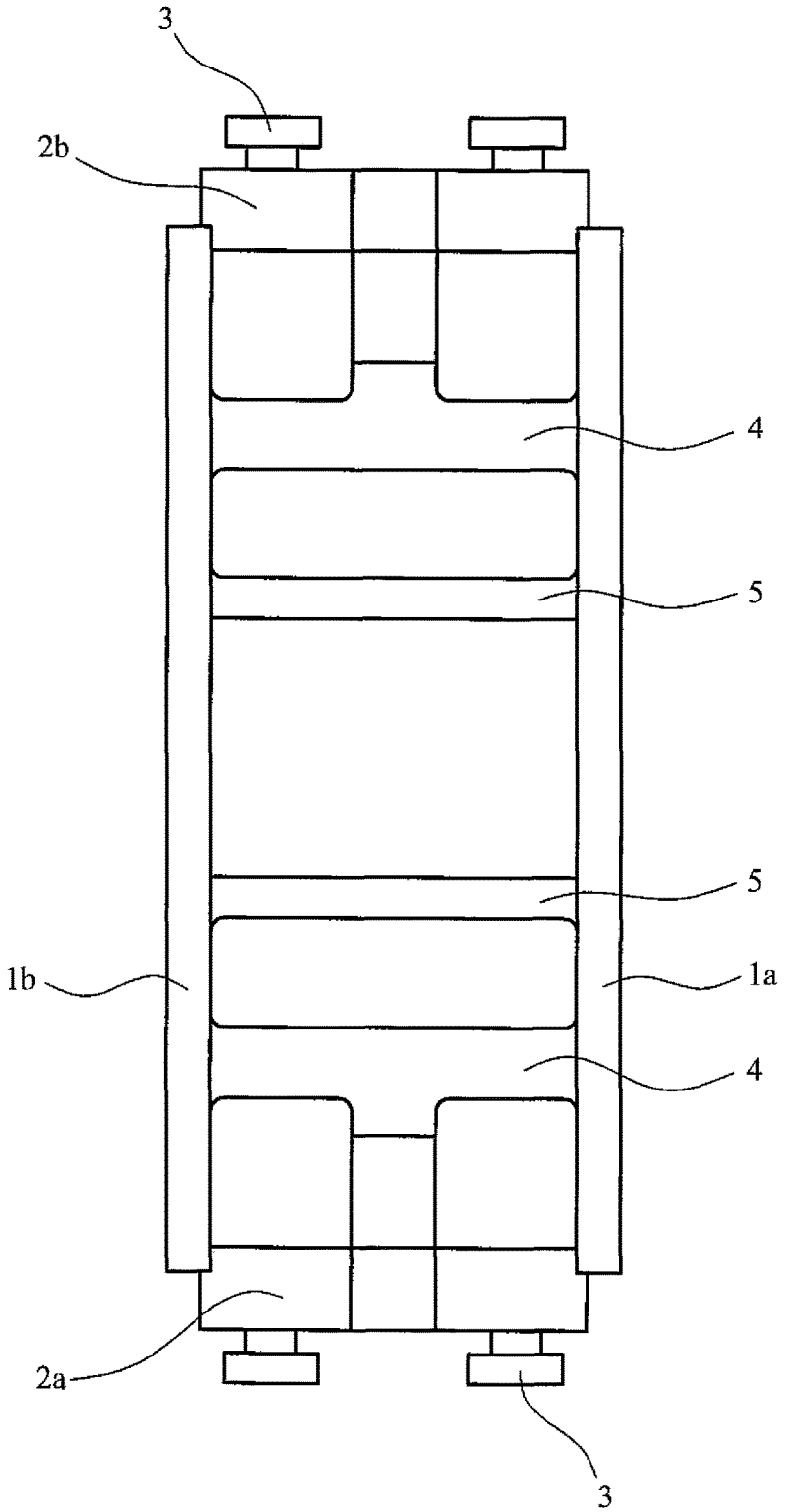
FIG. 1 depicts a top view of a conventional railway vehicle underframe comprising conventional channel shaped solebars.
Figure 2:
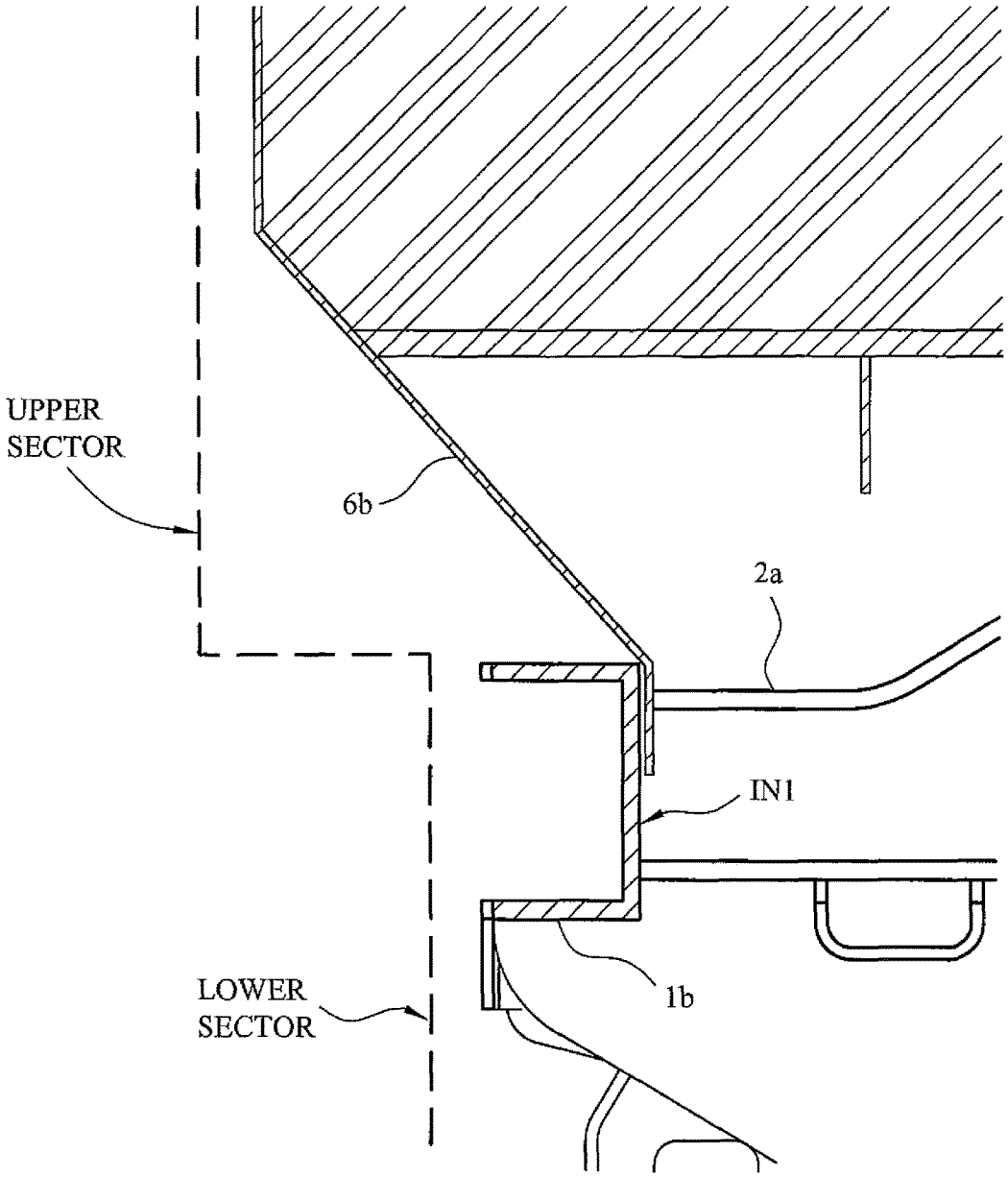
FIG. 2 depicts a partial end view of a conventional railway vehicle showing how a conventional channel shaped solebar is configured as part of the underframe in the conventional railway vehicle.
Figure 3:
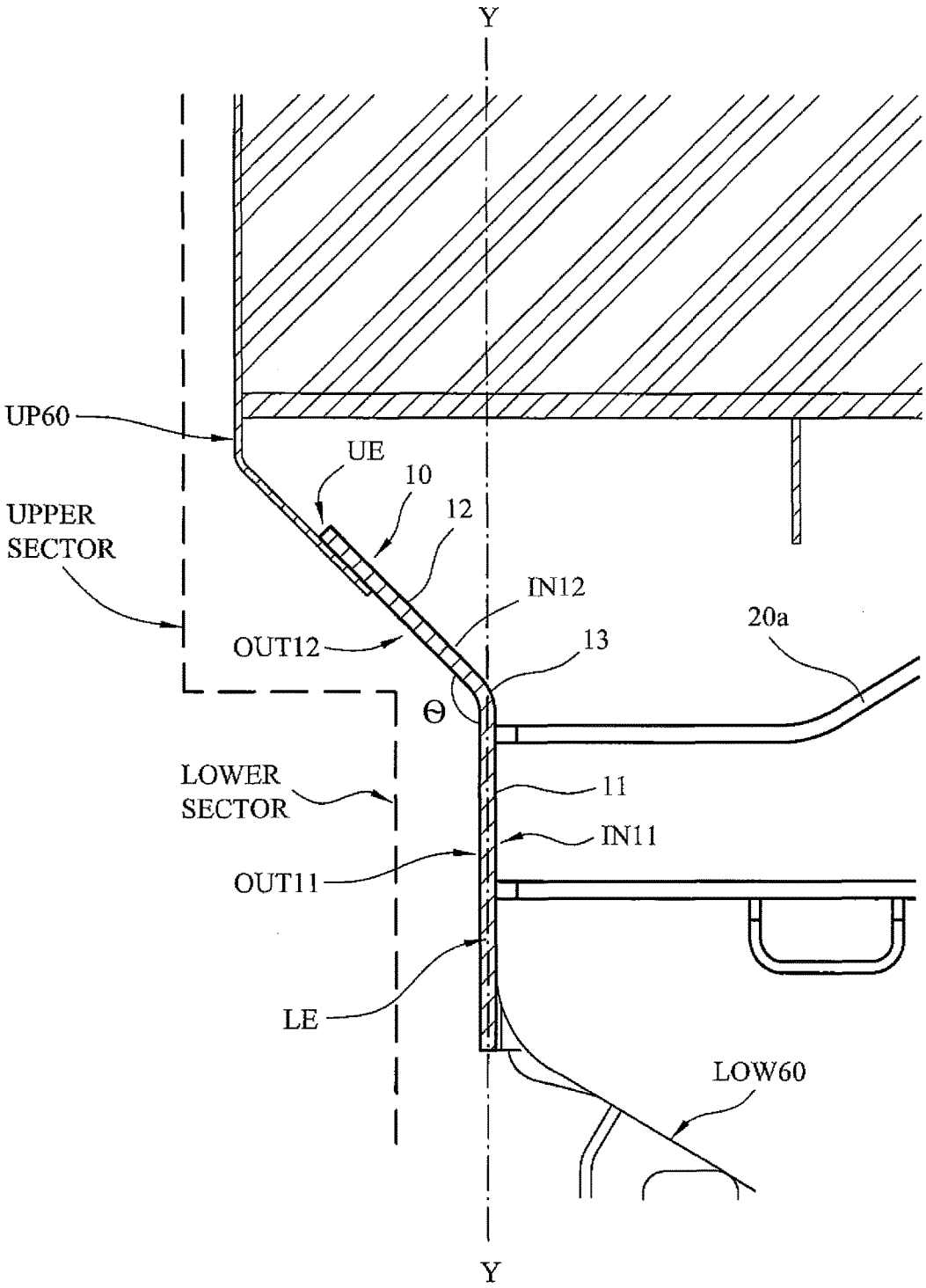
FIG. 3 depicts a partial end view of a railway vehicle showing how a solebar according to the present invention is configured as part of the underframe in the railway vehicle.

FIG. 3 depicts a partial end view of a railway vehicle showing how a solebar (10) according to the present invention is mounted as part of the underframe in a railway vehicle. The solebar extends longitudinally at least substantially along the length of the railway vehicle, forming a side member of the underframe. The first end section of the solebar is coupled to a first headstock (20*a*) and the second end section of solebar is coupled to a second headstock (20*b*, not shown). The solebar may be coupled to the headstocks and other underframe components using coupling means and/or a welding process. The coupling means may be nuts, bolts, rivets or any other suitable coupling means. The solebar and headstocks may be welded together using a penetration welding technique. The side edges (E) of the end portions of the solebar may be tapered to improve the weld.

The end regions of the solebar may be coupled to a sidewall of the respective headstocks. Hence, the end regions of the solebar are preferably dimensioned to correspond to the dimensions of the headstock sidewalls. For example, a first end region of the first leg may be configured to be coupled to the sidewall of the first headstock. A second end region of the first leg may be configured to be coupled to the sidewall of the second headstock.

It can be seen from FIG. 3 that the solebar is orientated such that the first leg extends downwardly towards a floor supporting the railway vehicle whilst the second leg extends upwardly at an incline in a direction away from the railway vehicle. Due to the orientation of the solebar, the first leg forms a "lower leg" and the second leg forms an "upper leg". The surfaces of the first leg and second leg facing inwardly form inner faces (IN11, IN12). While the surfaces of the first leg and second leg facing outwardly form outer faces (OUT11, OUT12). The longitudinal edge of the first leg edge forms a lower edge (LE) of the solebar and the longitudinal edge of the second leg forms an upper edge (UE) of the solebar.

To achieve loading gauge clearance, the solebar is arranged as part of the underframe in a railway vehicle such that it conforms to the loading gauge of the railway vehicle.

To achieve loading gauge clearance, increase the interior volume of the railway vehicle underframe and improve the mounting arrangement of the railway vehicle sidewalls on the solebar, the solebar is preferably positioned in the railway vehicle, as part of the underframe, such that the first leg conforms with the lower sector loading gauge and the second leg conforms with the upper sector loading gauge.

To achieve loading gauge clearance in the lower sector, the first leg of the solebar is configured to extend at least substantially parallel with the profile of the lower sector loading gauge. Given that the profile of the lower sector loading gauge is generally vertical, the solebar is preferably mounted in the railway vehicle such that the first leg extends vertically towards the floor along a vertical axis YY, as shown in FIG. 3. The first leg is preferably arranged in the railway vehicle such that it is located less than a predetermined lateral distance within the lower sector loading gauge. For example, the first leg may be arranged less than a lateral distance of approximately 50 mm from the lower sector loading gauge boundary.

To achieve loading gauge clearance in the upper sector, the second leg of the solebar is configured to extend upwardly at an incline within the upper sector loading gauge. Given that the profile of the upper sector loading gauge is generally stepped (offset) from the lower sector profile, the solebar is preferably mounted in the railway vehicle such that the second leg extends at an incline adjacent (across) the stepped portion of the loading gauge and towards the upper sector loading gauge boundary, as shown in FIG. 3. The second leg is preferably arranged in the railway vehicle less than a predetermined lateral distance within the upper sector loading gauge. For example, the second leg may be less than a lateral distance of approximately 50 mm from the upper sector loading gauge boundary.

To achieve the desired mounting configuration, the solebar may be arranged in the railway vehicle such that the vertex (13) is generally level with the top of the lower sector loading gauge or stepped portion of the loading gauge, as shown in FIG. 3.

Due to the mounting configuration of the solebar, the legs of the solebar follow the profile of the loading gauge more closely than conventional solebars and the cross-sectional width of the solebar in both the lower sector and the upper sector is minimised. Accordingly, the distance between a pair of opposing solebars in the underframe, and subsequently the interior volume of the underframe, is maximised. For example, due to the mounting configuration of the solebar, the first leg imitates the profile of the lower sector loading gauge and the cross-sectional width of the solebar in the lower sector is defined by the depth of the first leg—which is substantially less than the cross-sectional width of conventional solebars within the lower sector. Hence, the distance between the first legs of a pair of opposing solebars according to the present invention is comparatively greater than the distance between a pair of conventional solebars. By extending at an incline into the upper sector loading gauge in a direction away from the railway vehicle, the gap space between the second leg and the upper sector loading gauge boundary is reduced (minimised) and the distance between the second legs of a pair of opposing solebars is increased (optimised).

The solebar is configured to support one or more sidewalls (60) of the railway vehicle body.

Due to the obtuse L-shaped cross-sectional profile of the solebar and mounting configuration of the solebar in the railway vehicle the mounting arrangement of the railway body sidewalls is improved. The improved mounting arrangement provides a supporting effect on the sidewalls, achieves the loading gauge clearance of the railway vehicle body and improves the shape, size and volumetric capacity of the railway vehicle body.

For example, the solebar is configured for an upper sidewall (UP60) of a railway body to be mounted on the second leg. The solebar is configured such that the upper sidewall is coupled to the inner face and/or the outer face of the second leg, forming an overlapped upper sidewall portion within the upper sector loading gauge. Due to the overlap coupling arrangement, the second leg supports the upper sidewall. The upper sidewall extends beyond the end of the second leg at the same angle of inclination as the second leg, forming an inclined upper sidewall portion within the upper sector loading gauge. The upper sidewall then turns and extends in a generally upwardly direction forming an upright upper sidewall portion in the upper sector loading gauge. Due to the mounting arrangement, the upper sidewall is shaped such that it not only achieves loading gauge clearance but also corresponds more closely to the profile of the upper sector loading gauge than a conventional upper sidewall. The upper sidewall imitates the inclined profile of the second leg. Hence, the upper sidewall appears to extend continuously from the solebar and the railway body has a more streamline shape. Moreover, since the upper sidewall follows the profile more closely the upper sidewall the gap space between the upper sector loading gauge and the upper sidewall is reduced. Hence, the distance between opposing upper sidewalls mounted on the second legs of respective solebars increases and so the size and volumetric capacity of the railway body is improved.

Likewise, the solebar may be configured such that a lower sidewall (LOW60) of a railway body may be mounted on the first leg of the solebar. The solebar may be configured such that the lower sidewall may be coupled to the inner face and/or the outer face of the first leg such that it overlaps the first leg and forms an overlapping lower sidewall portion in the lower sector loading gauge within the lower sector loading gauge. The lower sidewall may be mounted to extend beyond the end of the first leg at the same angle of inclination as the first leg forming a parallel lower sidewall portion, parallel with the lower sector loading gauge. Hence, the lower sidewall is able to achieve loading gauge clearance and also conform more closely to the profile of the lower sector loading gauge. The first leg provides an improved supporting effect on the lower sidewall. The mounting of the lower sidewall on the first leg provides a continuous and streamline shape to the railway body and increases the size and the volumetric capacity of the railway body.

The solebar may be made from a metal material or any other suitable material with sufficient structural integrity. For example, the solebar may be made from stainless steel, aluminium, or carbon steel. When manufacturing the solebar, the material may be selected according to cost, availability and structural integrity. The material may be in sheet or plate form.

The solebar may be a one piece unit, whereby the first leg and second leg are integrally formed. The solebar may be manufactured by bending material with a plate-like form along a longitudinal axis until the first leg and second are formed and inclined by a predetermined obtuse angle θ.

Alternatively, the solebar may be formed from multiple sections coupled together (101, 102, 103). Each of the sections preferably comprise a first leg section (111, 112, 113) and a second leg section (121, 122, 123) that are configured to form an obtuse L-shaped cross-sectional profile with the same obtuse angle therebetween. The first leg section and second leg section may be integrally formed. Hence, when the solebar sections are coupled together along transverse edges, the sections form a solebar with an elongate body and an obtuse, L-shaped cross-sectional profile. The solebar may comprise a first end section, one or more central sections and a second end section. The configuration of the first end section may mirror the configuration of the second end section. Each section may be formed by bending material with a plate-like form along a longitudinal axis until the first leg section and second leg section are formed and inclined by a predetermined obtuse angle θ. The multiple sections may be coupled together using coupling means and/or a welding process. The coupling means may comprise nuts, bolts, rivets or any other suitable coupling means. The welding process may be a weld penetration technique. The transverse side edges of the section may be tapered to improve the weld between the sections.

It will be understood that the dimensions of the solebar—for example, the length, height, width and obtuse angle θ between the first leg and second leg of the solebar—will depend upon the type and size of railway vehicle and the loading gauge.

For example, depending on the size of the railway underframe required, the length (L) of the solebar may fall within the range of approximately 10 m to 20 m, the height (H) of the solebar may fall within the range of approximately 30 cm to 50 m and the width (W) of the solebar may fall within the range of approximately 10 cm to 20 cm.

The obtuse angle θ is preferably selected to optimise the compliance of the legs and sidewalls with the profile of the loading gauge, and subsequently the size and volumetric capacity of the body. Given that the obtuse angle θ influences the shape of the body, the obtuse angle θ is preferably selected to enhance the shape of the body. If the railway vehicle is a hopper wagon with outlets formed in the floor of the hopper wagon, the obtuse angle θ may be selected such that the second leg, overlapping upper sidewall portions and inclined upper sidewall portions are inclined at an angle that aids (optimises) the outflow of bulk commodities. For example, the obtuse angle θ may range from approximately 105° to 165°. For a hopper wagon transferring biomass products, the flow of biomass products towards an outlet formed in the floor of the railway vehicle body is enhanced if the inclined upper sidewall portions are inclined at an angle in the range of approximately 15° to 45°, preferably 30° with respect to a horizontal plane. So as to achieve this, the solebar is configured such that when the first leg extends along a vertical axis the second leg is inclined at an obtuse angle in the range of approximately 105° to 135°, preferably 120° with respect to the first leg. For a hopper wagon transferring coal, the second leg is preferably inclined at an obtuse angle of approximately 150° with respect to the first leg such that the inclined upper sidewall portion is inclined at an angle of approximately 60° with respect to a horizontal plane.

The first leg and the second leg of the solebar may have substantially the same longitudinal length. For example, the first leg and second leg may have the same longitudinal length such that the side edges at each end region of the solebar have a flush profile. Alternatively, the first leg and second leg may have different longitudinal lengths. For example, the first leg may comprise end portions that protrude longitudinally beyond the second leg such that both end regions of the solebar have a stepped longitudinal profile. The side edges of the second leg may taper or curve towards the protruding end portions of the first leg. If the solebar comprises multiple sections coupled together then the first legs of each end section may be configured to have a longer longitudinal length than the second legs of each end section so that the first legs protrude longitudinally relative to the second legs.

The first leg and the second leg of the solebar may have substantially the same transverse length. Alternatively, the first leg and the second leg may have different transverse lengths. For example, the first leg may have a longer transverse length than the second leg.

The transverse length of the first leg may be substantially uniform or vary along the length of the solebar. Likewise, the transverse length of the second leg may be substantially uniform or vary along the length of the solebar. For example, the transverse length of a leg may vary because it is shaped, tapered, stepped, indented or cut away. In another example, the first leg may comprise opposing end portions that protrude transversely beyond the first leg in a central region of the solebar. As a result, the first leg of the solebar has a stepped transverse profile. If the solebar comprises multiple sections coupled together then the first leg of each end section may be configured to have a longer cross-sectional length than the first leg of the central section(s) so that the first legs of the end sections protrude transversely.

The solebar may further include one or more infill sections mounted to infill at least a portion of the transverse stepped recesses in the first leg. The infill sections may have a generally triangular shape. The infill sections are provided to help improve the structural integrity of the solebar and absorb buffering loads transferred via the headstock. The infill sections may be coupled to the first leg of the solebar using coupling means and/or a welding process. The coupling means may be nuts, bolts, rivets or any other suitable coupling means. The infill sections may be welded to the first leg using a penetration welding technique. The side edges of the infill sections may be tapered to improve the weld.

The solebar may have a substantially uniform depth (thickness). Alternatively, the depth of the solebar may vary. For example, the end region of a solebar may be formed from a thicker material than the central region to help improve the structural integrity of the solebar and withstand the buffer compression loads. If the solebar comprises multiple sections coupled together then the end sections may be formed from thicker metal plate than the central section or sections.

The solebar may comprise one or more recess (indent). For example, a peripheral edge of the end region may be shaped, tapered, curved, stepped and/or inclined to form an indent. The recess may be configured such that the solebar can be fitted around and/or allow access to other component parts of the railway vehicle. The recess may be formed if an end portion of the first leg protrudes longitudinally beyond the second leg in an end region of the solebar.

One or both end regions of the solebar may be inclined by angle β with respect to the longitudinal axis of the solebar so as to provide a tapering effect. The end regions of the solebar are preferably inclined such that, when the solebar is mounted as part of the underframe, the end regions taper inwardly. Since the sidewalls of the body are mounted on the solebar, the end region/corners of the body will taper accordingly due to the taper of the solebar. The end regions of the solebar may taper inwardly so as to counteract curve overthrow and help maintain the gauge clearance of the underframe and the body as the railway vehicle travels along curved section of track. The tapering angle β may depend upon the length of the railway vehicle, the distance between the bogies and the end of the railway vehicle and/or the loading gauge of the railway route. The tapering angle β may be selected from the range of approximately 2° to 4°. One or both end regions of the solebar may be tapered by bending the end region with respect to the longitudinal axis of the solebar by a predetermined angle β. Preferably, one or both end regions are bent such that they taper inwardly, in the opposite direction to the protruding (extending) direction second leg. Alternatively, if the solebar is formed from multiple sections, then one or both end regions of the solebar may be tapered by using end sections that are preformed to have a taper configuration of predetermined angle β when coupled to the central section or sections. The end sections are preferably preconfigured to taper inwardly.

Figure 4A:
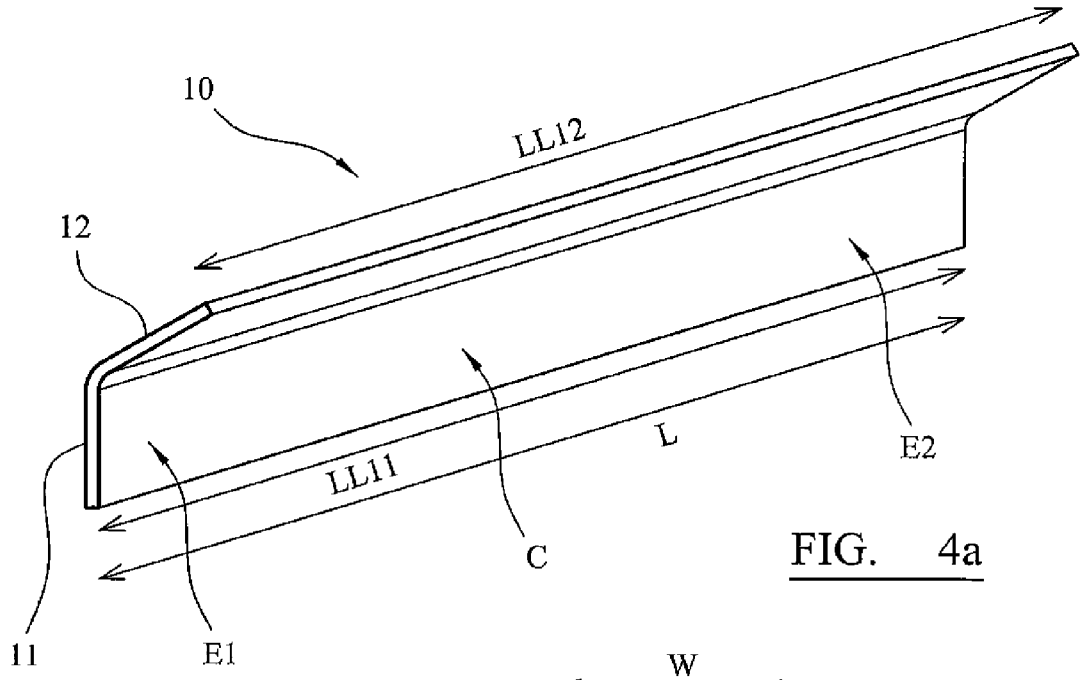
FIG. 4*a* depicts a perspective front view of a first embodiment of a solebar according to the present invention.
Figure 4B:
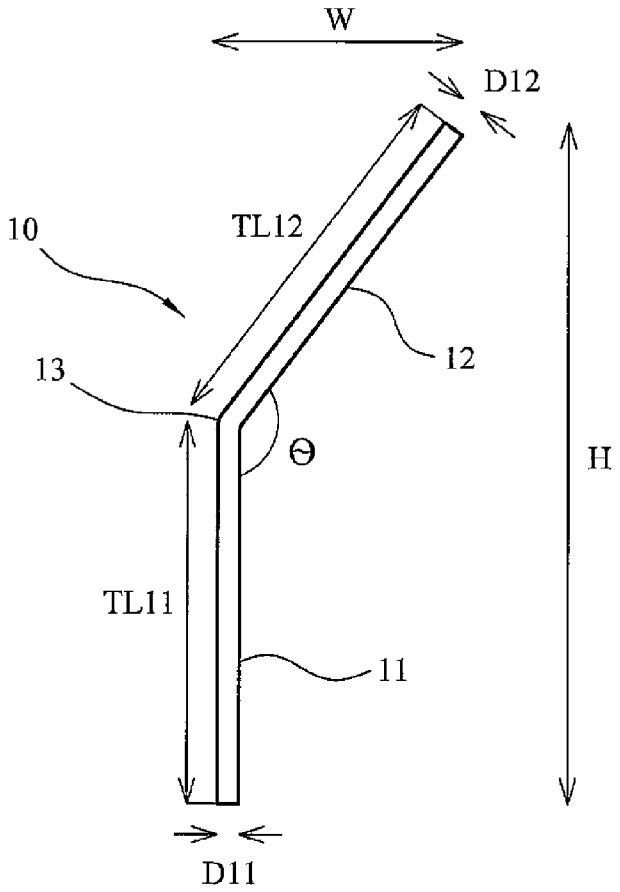
FIG. 4*b* depicts a cross-sectional view of the first embodiment of the solebar of FIG. 4*a;*
Figure 4C:
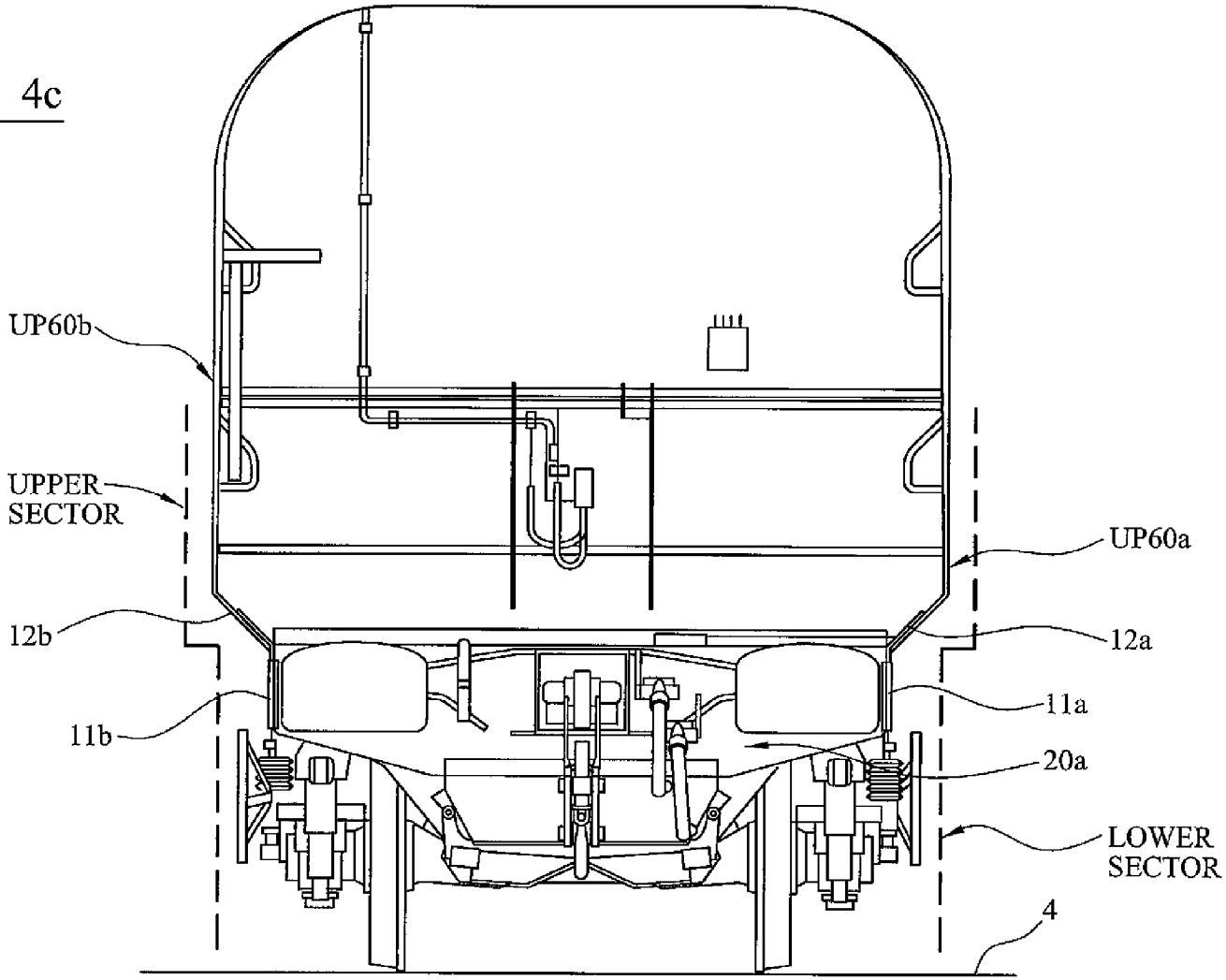
FIG. 4*c* depicts the first embodiment of the solebar of FIG. 4*a* configured as part of the underframe of a railway vehicle.

FIGS. 4*a*, 4*b* and 4*c* depict views of a first embodiment of a solebar according to the present invention. FIG. 4*a* depicts a perspective front view of the first embodiment of a solebar. FIG. 4*b* depicts a cross-sectional view of the first embodiment of the solebar. FIG. 4*c* depicts the first embodiment of the solebar configured as part of the underframe of a railway vehicle.

The solebar (10) is an elongate structural member with an obtuse L-shaped cross-sectional profile. The solebar comprises a first leg (11) and a second leg (12). The first leg and second leg meet at a vertex (13), forming an obtuse angle θ of approximately 135° therebetween. The vertex extends along the length of the solebar.

The solebar bar has a length (L), width (W), height (H), first end region (E1), central region (C) and a second end region (E2). The first leg has a longitudinal length (LL11), transverse length (TL11) and depth (D11). Likewise, the second leg has a longitudinal length (LL12), transverse length (TL12) and depth (D12).

In this particular embodiment, the solebar is manufactured by bending a rectangular shaped stainless steel sheet (approximately 400 mm wide and approximately 18 m long) along its longitudinal axis to form the first leg and the second leg. The bending process continues until the second leg is inclined by the obtuse angle of approximately 135° relative to the first leg. Due to the length of the metal sheet, the length (L) of the solebar is approximately 18 m. The height (H) of the solebar is approximately 342 mm and the width (W) of the solebar is approximately 142 mm. The metal sheet has a uniform depth of approximately 10 mm and so the first leg and second leg both have a substantially uniform depth (D11, D12) of approximately 10 mm. By bending the metal sheet along the central longitudinal axis, the first leg and second leg have substantially the same longitudinal length (LL11, LL12) of approximately 18 m and substantially the same transverse length (TL11, TL12) of 200 mm. Moreover, the elongate body is regular along its length.

By forming the solebar from the metal sheet, the solebar is a one piece unit with a joint free construction. The manufacturing process is therefore both simple and economic.

In use, the first embodiment of the solebar forms a longitudinal side member of a railway underframe. FIG. 4*c* depicts an end view of a railway vehicle where the underframe comprises a first solebar (10*a*) and a second solebar (10*b*) according to the first embodiment design. The opposing solebars are orientated such that the first legs (11*a*, 11*b*) extend within the lower sector loading gauge (LOWER SECTOR) in a direction towards the floor (F), parallel to the profile of the lower sector loading gauge. The second legs (12*a*, 12*b*) extend upwardly at an incline within the upper sector loading gauge (UPPER SECTOR) in a direction away from the railway vehicle. A first upper sidewall (UP60*a*) of the railway body is mounted on the second leg of the first solebar. A second upper sidewall (UP60*b*) of the railway body is mounted on the second leg of the second solebar. Due to the obtuse L-shaped cross-sectional profile and mounting configuration of the solebars, the sidewalls extend continuously from the second legs of the solebar forming a railway body with a streamline shape. The sidewalls are inclined towards the upper sector loading gauge by the same angle of inclination as the second legs. As a result, the sidewalls are able to follow the profile of the upper sector loading gauge more closely (than a conventional railway vehicle) such that the gap space between sidewalls and the upper sector loading gauge is reduced. Accordingly, the sidewalls form a railway vehicle body with an improved shape, size and volumetric capacity whilst achieving loading gauge clearance.

Figures 5A, 5B:
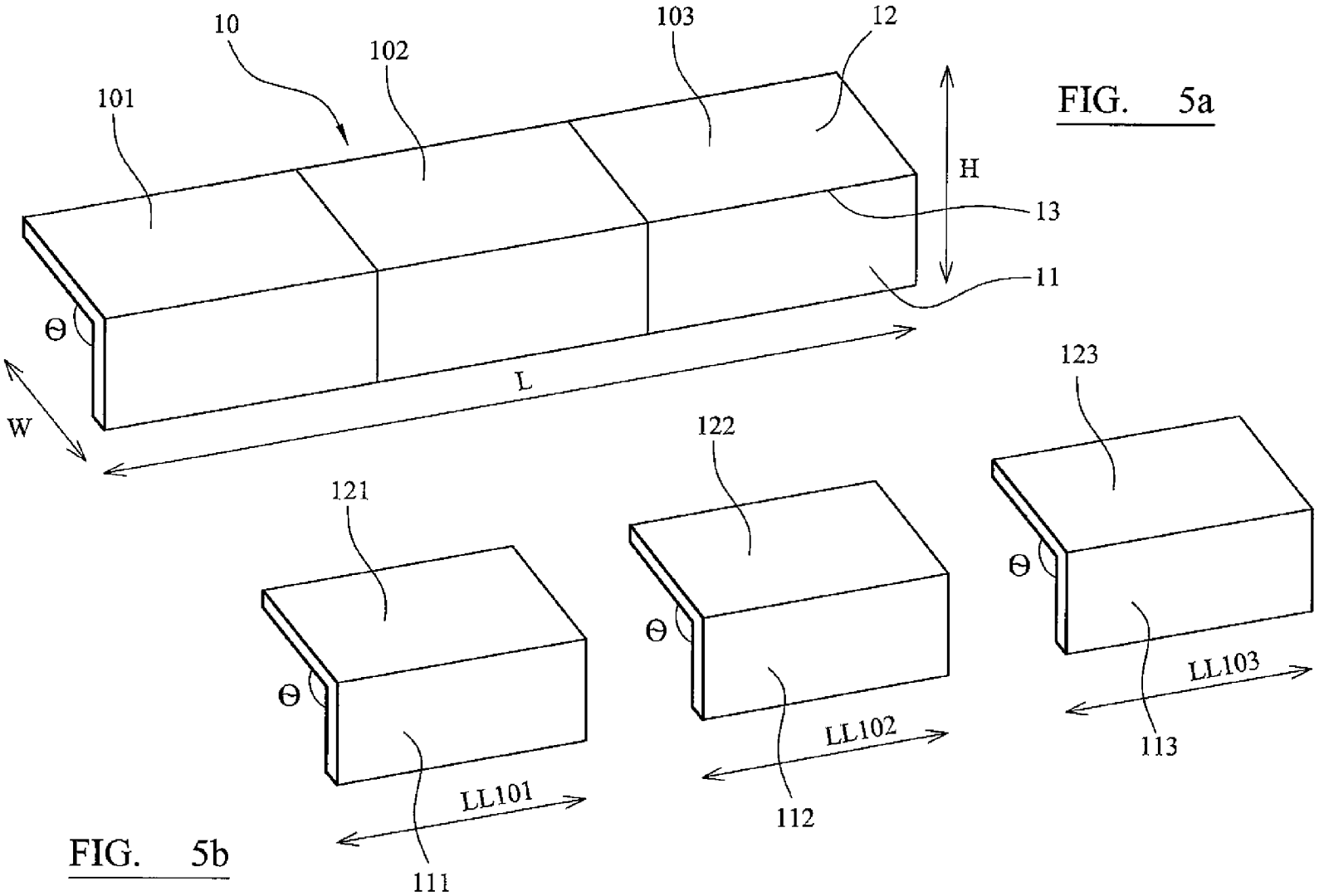
FIG. 5*a* depicts a perspective rear view of a second embodiment of a solebar according to the present invention.
FIG. 5*b* depicts a perspective exploded rear view of the second embodiment of the solebar of FIG. 5*a;*

FIGS. 5*a* and 5*b* depicts views of a second embodiment of a solebar according to the present invention. FIG. 5*a* depicts a perspective rear view of the second embodiment of the solebar. FIG. 5*b* depicts an exploded rear view of the second embodiment of the solebar.

The solebar (10) comprises a first leg (11) and second leg (12) that are configured to form an elongate body with an obtuse L-shaped cross-sectional profile. In this embodiment, the first leg and second leg meet at the vertex (13) with an obtuse angle θ of approximately 120°. The solebar has a length (L) of approximately 18 m, a width (W) of approximately 173 mm and a height (H) of approximately 450 mm.

Rather than being a one piece unit, the solebar is formed from multiple sections coupled together. In this second embodiment, the solebar is formed from a first end section (101), a central section (102) and a second end section (103) coupled together. Each section comprises a first leg section (111, 112, 113) and a second leg section (121, 122, 123) configured to form an obtuse L-shaped cross-sectional profile with the same obtuse angle θ of 120° therebetween.

Each solebar section is formed by bending a rectangular sheet of stainless steel along a longitudinal axis until the first leg section and second leg section are formed with an obtuse angle of 120°. The transverse side edges of each section are then coupled together using a welding process. The transverse side edges are tapered to improve the welding process.

The first leg sections in each of the solebar sections have the same dimensions. Likewise, the second leg sections in each of the solebar sections have the same dimensions. Hence, when the solebar sections are coupled together, the solebar sections are aligned, forming a regular and continuous elongate body with flush edges and an obtuse L-shaped cross-sectional profile. In the embodiment depicted, the longitudinal length of each solebar section (LL101, LL102, LL103) is approximately 6 m, the transverse length of each leg is approximately 200 mm and the depth of each leg is approximately 10 mm.

Figure 6A:
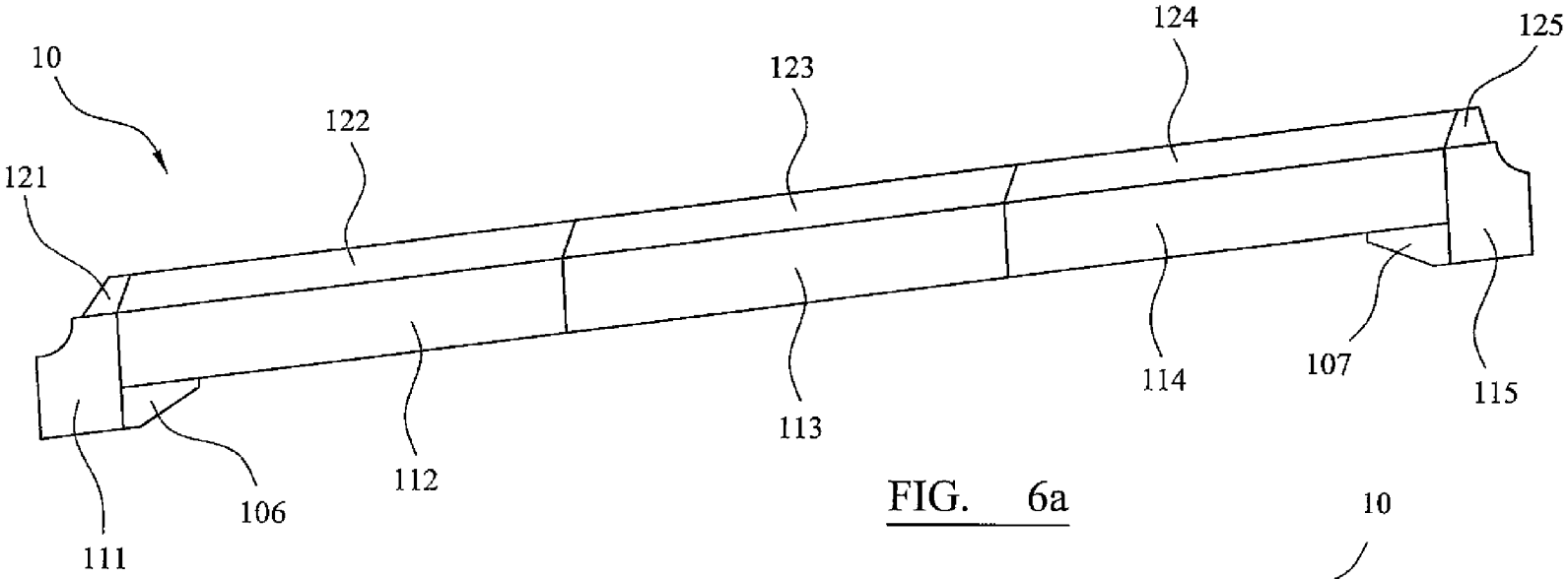
FIG. 6*a* depicts a perspective rear view of a third embodiment of the solebar according to the present invention.
Figure 6B:
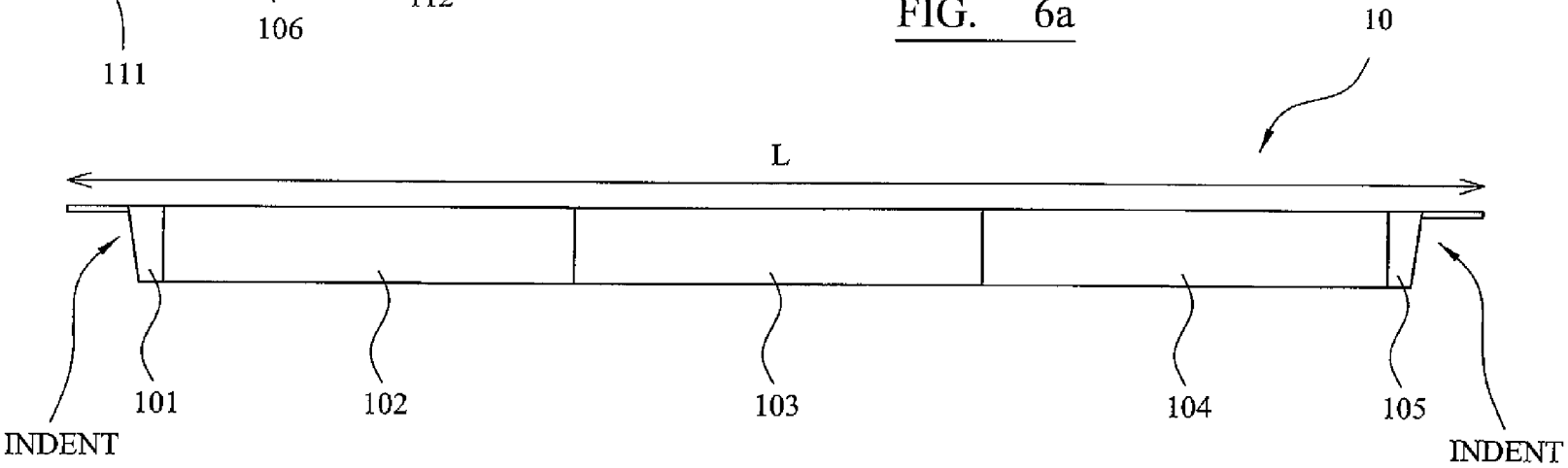
FIG. 6*b* depicts a top view of the third embodiment of the solebar of FIG. 6*a;*
Figure 6D:
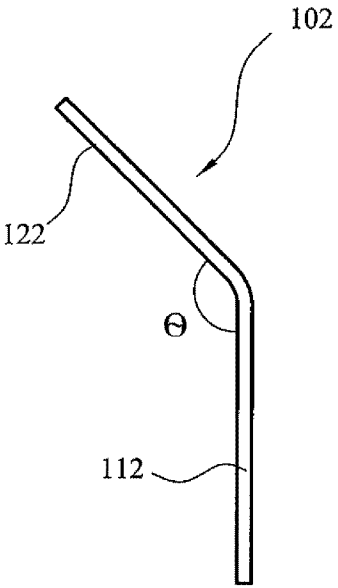
FIG. 6*d* depicts a cross-sectional view of a central section of the solebar of FIG. 6*a;*
Figure 6C:
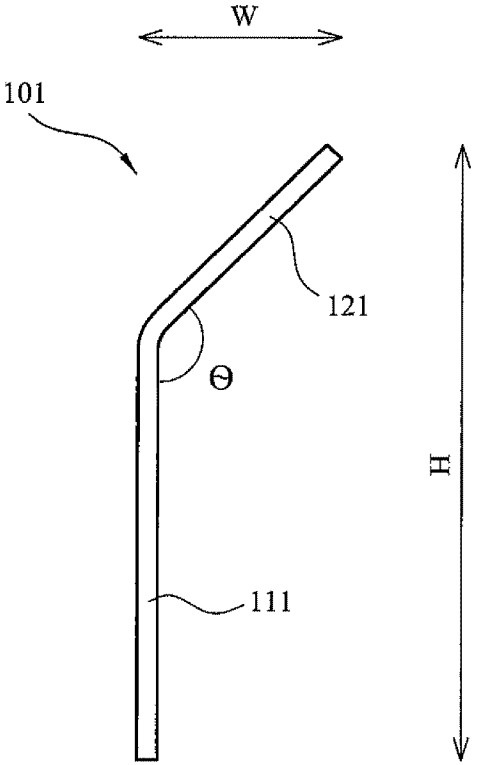
FIG. 6*c* depicts a cross-sectional view of an end section of the solebar of FIG. 6*a;*
Figure 6E:
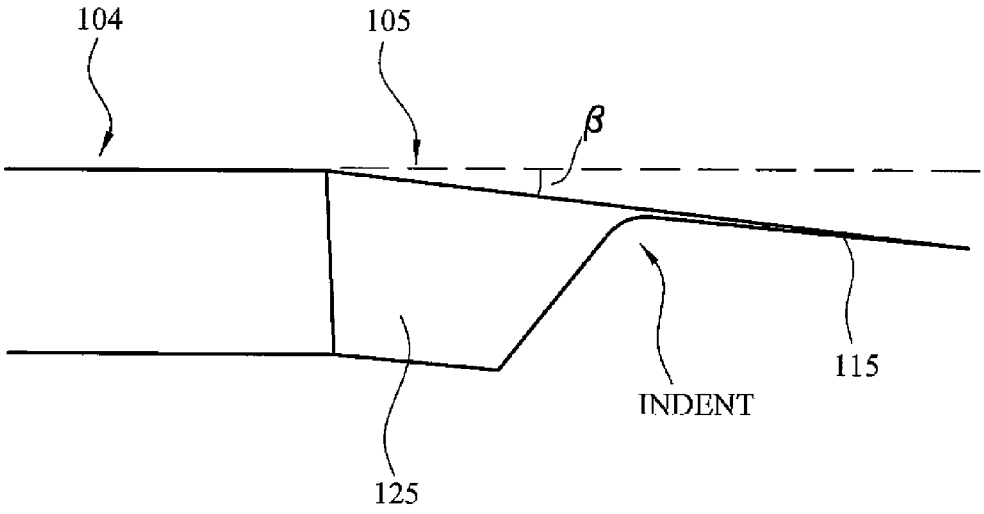
FIG. 6*e* depicts a top view of an end section of the third embodiment of the solebar of FIG. 6*a;*
Figure 6F:
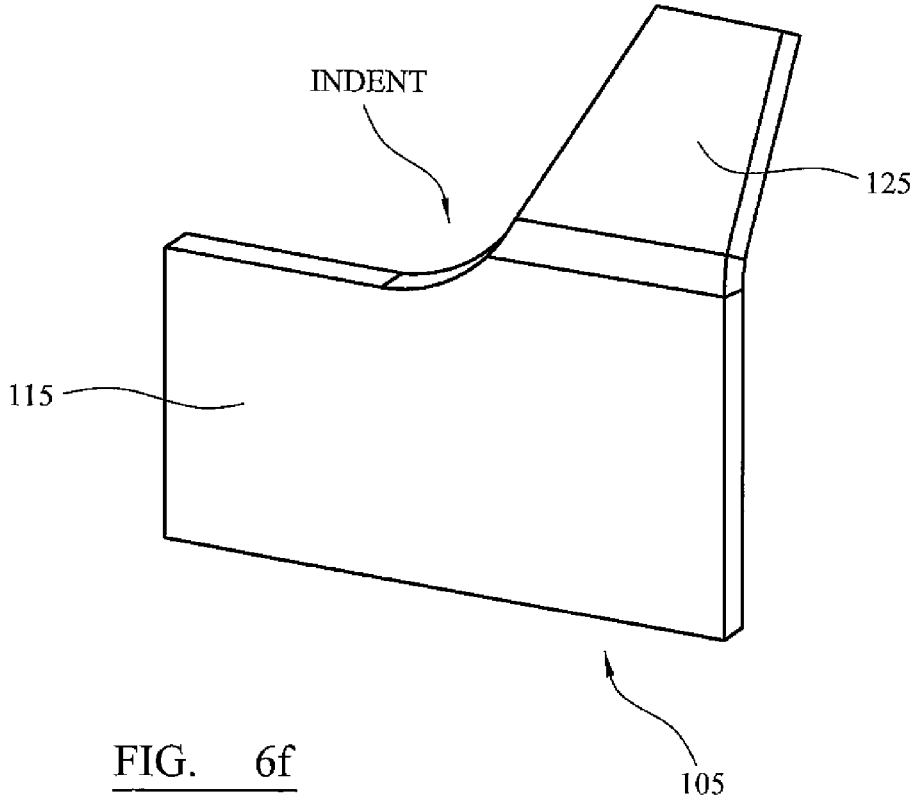
FIG. 6*f* depicts a perspective rear view of an end section of the third embodiment of the solebar of FIG. 6*a;*
Figure 6G:
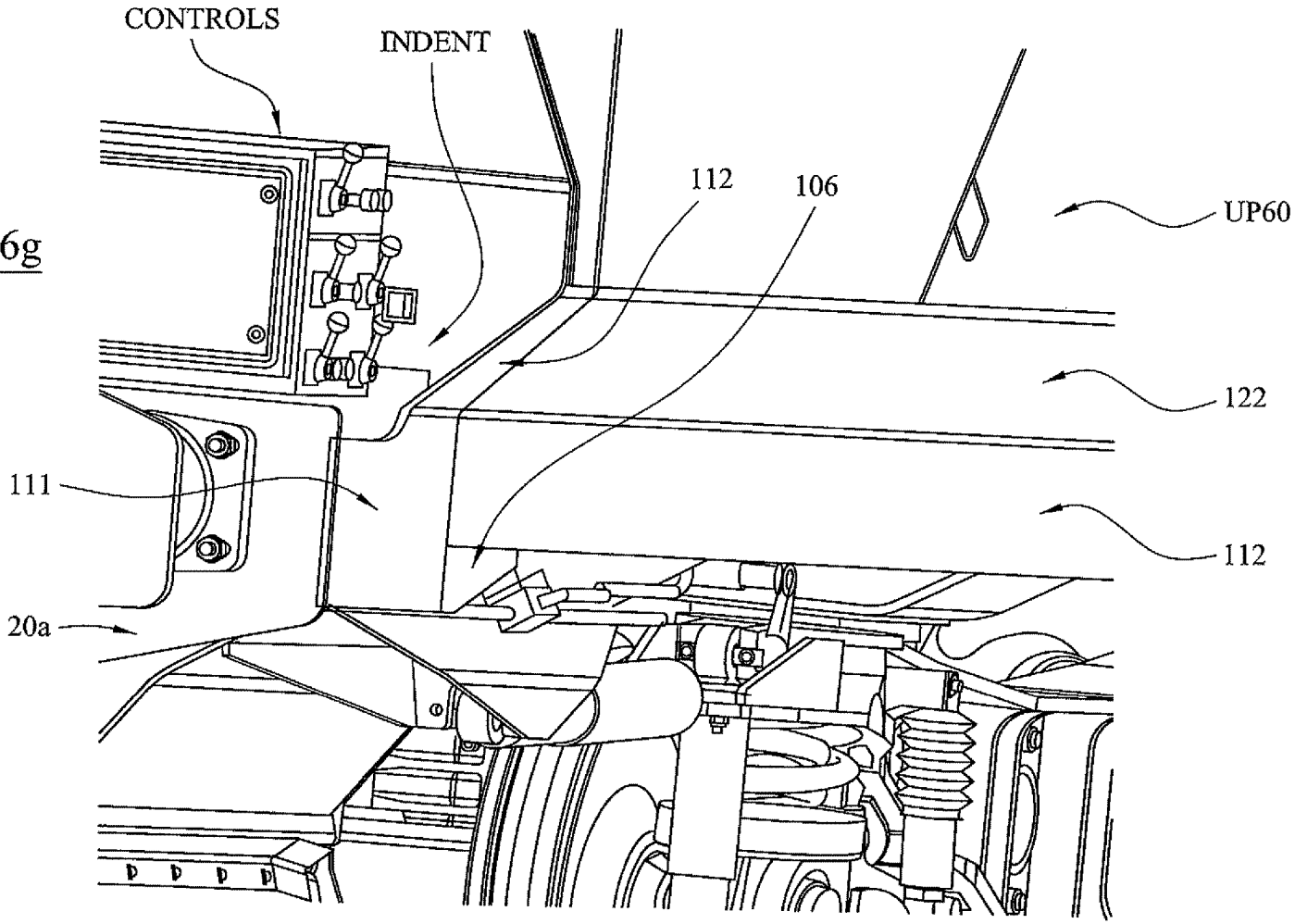
FIG. 6*g* depicts a partial side view of a railway vehicle where a third embodiment of the solebar of FIG. 6*a* is configured as part of railway vehicle underframe.

FIGS. 6*a* to 6*g* depict a third embodiment of a solebar for a railway vehicle. In the third embodiment, the solebar (10) has an obtuse L-shaped cross-sectional profile however, the end regions of the solebar have a different longitudinal profile and a different transverse profile to the central region. FIG. 6*a* depicts a perspective rear view of the third embodiment of the solebar. FIG. 6*b* depicts a top view of the solebar. FIG. 6*c* depicts a cross-sectional view of an end section of the third embodiment of the solebar. FIG. 6*d* depicts a cross-sectional view of a central section of the third embodiment of the solebar. FIG. 6*e* depicts a top view of the first end section of the solebar. FIG. 6*f* depicts a perspective rear view of the first end section of the solebar. FIG. 6*g* depicts the third embodiment of the solebar configured as part of a railway vehicle.

As shown in FIGS. 6*a* and 6*b*, the third embodiment of the solebar (10) comprises a first end section (101), three central sections (102, 103, 104) and a second end section (105) coupled together. The first end (101) section is a mirror image of the second end section (105). The three central sections are substantially identical.

Each section of the solebar comprises a first leg section (111, 112, 113, 114, 115) and second leg section (121, 122, 123, 124, 125) configured to form an obtuse L-shaped profile with the same obtuse angle θ of 135° therebetween. Hence, when the sections are coupled together, the solebar has an elongate body with an obtuse L-shaped cross-sectional profile.

Each section of the solebar is formed by bending a stainless steel sheet along a longitudinal axis until the first leg section and second leg section are inclined at the obtuse angle θ of 135°. As shown in FIGS. 6*c* and 6*d*, the maximum transverse length of the second leg sections of each solebar section are approximately 180 mm. The transverse length of the first leg section of each end section is approximately 300 mm. The transverse length of the first leg section of each central section is approximately 200 mm. The solebar has an overall length of approximately 18 m, maximum height of approximately 452 mm and width of approximately 167 mm.

The sections of the solebar are coupled together using a welding process. The side edges of the sections are tapered by approximately 30° to improve the weld. The welding process includes a penetration welding technique.

The end sections of the solebar are formed from a thicker stainless steel plate than the central section so as to improve the structural integrity of the solebar and help to absorb buffering loads. As shown in FIGS. 6*c* and 6*d*, the depth of the solebar end sections is approximately 15 mm whereas the depth of the solebar central sections is approximately 10 mm. So as to ensure the loading gauge clearance is maintained, the sections of the solebar are welded together such that the outer surface along the length of the solebar is flush. As a result, the inner surface along the length of the solebar is stepped.

As shown in FIG. 6*e*, the end sections of the solebar have a tapered longitudinal profile relative to the central sections. The end sections of the solebar taper inwardly (away from the protruding direction of the second leg) by an angle β relative to the longitudinal axis of the solebar. In this embodiment, the end pieces taper inwardly by an angle β of approximately 2.5°. The solebar tapers so as to provide the underframe, and therefore the railway body mounted on the underframe with inwardly tapering corners. The taper of solebar helps to maintain loading gauge clearance whilst the railway vehicle is travelling along a curved section of track.

The first leg sections of each end section are configured to be welded to the sidewalls of the headstocks (only 20*a* shown). The configuration of the first leg sections preferably corresponds to the configuration of the sidewall of the headstock so as to enhance the weld and improve the transfer of buffering loads via the headstock and along the solebar. The peripheral edge of the first leg sections may be tapered by approximately 30° to further improve the weld.

It can be seen in FIGS. 6*a* to 6*g* that the first leg sections extend longitudinally beyond the second leg sections in each solebar end section because the first leg sections have a longer longitudinal length than the second leg sections. As a result, the solebar has a stepped longitudinal profile. In this embodiment, the second leg sections are configured to taper towards the respective first leg sections. Hence, the solebar end sections appear to have been cut away or recessed to form an indent (INDENT). The indent defined by the tapered peripheral edge in the solebar end sections is configured to allow manual access or visual access to controls (CONTROLS) mounted on the headstocks as shown in FIG. 6*g*. The longitudinal length of the first leg sections in each solebar end section is selected to optimise the coupling with the sidewalls of the headstock and improve the structural integrity of the solebar.

It can also be seen in FIGS. 6*a* to 6*g* that the first leg sections of each solebar end section extend transversely beyond the first leg sections of the solebar central sections because the first leg sections in the solebar end sections have a longer transverse length by approximately 100 mm. As a result, the solebar has a stepped transverse profile. The transverse length of the first leg sections of each solebar end section is selected to match the transverse dimensions of the adjoining sidewall of the headstocks (only 20*a* shown) and further improve the structural integrity of the solebar.

Infill sections (106, 107) are mounted in the stepped recess between the first legs of the end pieces and the first legs of the central region. The infill sections have a generally triangular shape. The infill sections are welded to the end sections and adjacent central section. The infill sections improve the structural integrity of the solebar.

When a pair of solebars according to the third embodiment of the invention are mounted as longitudinal side members of a railway underframe, the first legs of the solebars extend vertically within the lower sector loading gauge towards the floor and the second legs extend upwardly at an incline within the upper sector loading gauge in a direction away from the railway vehicle. Upper sidewalls (UP60) of the railway body are mounted on the second legs of the central sections of the solebars. Due to the obtuse L-shaped cross-sectional profile and mounting configuration of the solebars, the upper sidewalls appear to extend continuously from the central sections of the solebars forming a railway body with a streamline shape. The sidewalls are inclined towards the upper sector loading gauge by the same angle of inclination as the second legs of the central sections of the solebars and thereby imitate the profile of the upper sector loading gauge. As a result, the upper sidewalls form a railway vehicle body with loading gauge clearance and an enhanced shape, size and volumetric capacity.

Whilst endeavouring in the foregoing specification to draw attention to those features of the invention believed to be of particular importance, it should be understood that the applicant claims protection in respect of any patentable feature or combination of features referred to therein, and/or shown in the drawings, whether or not particular emphasis has been placed thereon.

Throughout the description and claims of this specification, the words "comprise" and "contain", and any variations of the words, means "including but not limited to" and is not intended to (and does not) exclude other features, elements, components, integers or steps.

Throughout the description and claims of this specification, the singular encompasses the plural unless the context requires otherwise. In particular, where the indefinite article is used, the specification is to be understood as contemplating plurality as well as singularity, unless the context requires otherwise.

Features, integers or characteristics described in conjunction with a particular aspect, embodiment or example of the invention are to be understood to be applicable to any other aspect, embodiment or example described herein unless incompatible therewith.

The invention claimed is:

1. A solebar for a railway vehicle, the solebar having an elongate body with a generally obtuse L-shaped cross-sectional profile, whereby the elongate body comprises a first leg and a second leg, wherein the first leg and the second leg are configured to meet at a vertex and have an obtuse angle therebetween and wherein the solebar is mounted as an underframe side member in a railway vehicle such that:

the first leg extends in a downwardly direction towards a floor supporting the railway vehicle and clears a lower sector of a loading gauge; and the second leg inclines upwardly in a direction away from railway vehicle and clears an upper sector of the loading gauge;

wherein the second leg is configured to support an upper sidewall of a body of the railway vehicle such that the upper sidewall clears the upper sector of the loading gauge.

2. A solebar according to claim 1, wherein the vertex extends at least substantially along the length of the elongate body.

3. A solebar according to claim 1, wherein the first leg is configured to support a lower sidewall of the body of the railway vehicle such that the lower sidewall clears the lower sector of the loading gauge.

4. A solebar according to claim 1, wherein the obtuse angle (θ) is selected from a range of approximately 105° to 165°.

5. A solebar according to claim 1, wherein the solebar is a one piece unit.

6. A solebar according to claim 1 wherein the solebar comprises multiple solebar sections coupled together.

7. A solebar according to claim 6, whereby each of the solebar sections comprises a first leg section and second leg section that are configured to meet at a vertex with the same obtuse angle therebetween such that each solebar section has the same obtuse L-shaped cross-sectional profile.

8. A solebar according to claim 1, wherein the solebar comprises a first end region, a central region and a second end region.

9. A solebar according to claim 8, wherein the first end region is formed by a first end section, the central region is formed by one or more central sections and the second end region is formed by a second end section.

10. A solebar according to claim 8, wherein the first end region and/or the second end region tapers inwardly relative to the central region by a taper angle (β).

11. A solebar according to claim 8, wherein the first end region and/or the second end region of the solebar comprises an indent.

12. A solebar according to claim 11, wherein the indent of the first end region and/or the second end region is configured such that the solebar can be fitted around other component parts of the railway vehicle.

13. A solebar according to claim 8, wherein the first leg in a first end region and/or the second end region of the solebar has a longer longitudinal length than a respective second leg in the first end region and/or second end region of the solebar.

14. A solebar according to claim 8, wherein a first leg in the first end region and/or the second end region of the solebar has a longer transverse length than the first leg in the central region.

15. A solebar according to claim 14 further comprising an infill section that is configured to infill at least a portion of a transverse recess formed in the first leg between one of the end regions and the central region.

16. A solebar according to claim 8, wherein at least a portion of the first leg in the first end region of the solebar is configured to be coupled to a first headstock and at least a portion of the first leg in the second end region of the solebar is configured to be coupled to a second headstock.

17. A solebar according to any preceding claim, wherein the solebar is suitable for use in a railway vehicle, including a locomotive, a passenger vehicle and a non-passenger vehicle.

18. An underframe of a railway vehicle comprising a first solebar as claimed in claim 1.

19. The underframe according to claim 18, further comprising a second solebar, whereby the second solebar has an elongate body with an obtuse L-shaped cross-sectional profile.

20. A railway vehicle comprising a first solebar arranged to form a first underframe side member whereby the first solebar has an elongate body with an obtuse L-shaped cross-sectional profile, whereby the elongate body comprises a first leg and a second leg, wherein the first leg and the second leg are configured to meet at a vertex and have an obtuse angle therebetween and wherein the solebar is mounted as an underframe side member in a railway vehicle such that:

the first leg extends in a downwardly direction towards a floor supporting the railway vehicle and clears a lower sector of a loading gauge; and the second leg inclines upwardly in a direction away from railway vehicle and clears an upper sector of the loading gauge;

wherein the second leg is configured to support an upper sidewall of a body of the railway vehicle such that the upper sidewall clears the upper sector of the loading gauge.

21. A railway vehicle according to claim 20, wherein the first solebar is arranged such that the first leg has loading gauge clearance with the lower sector and the second leg has loading gauge clearance with the upper sector.

22. A railway vehicle according to claim 21 wherein the first leg of the solebar is parallel to a profile of the lower sector.

23. A railway vehicle according to claim 21, wherein the second leg of the solebar is adjacent to a profile of the upper sector loading gauge.

24. A railway vehicle according to claim 20, wherein the upper sidewall of the body of the railway vehicle is mounted on the second leg of the solebar.

25. A railway vehicle according to claim 24, wherein the upper sidewall comprises an overlapping upper sidewall portion coupled to the second leg in an overlapping manner, an inclined upper sidewall portion extending beyond the end of the second leg at the same angle of inclination as the second leg and an upright upper sidewall portion extending in a generally upright direction.

26. A railway vehicle according to claim 20, wherein a lower sidewall of the railway vehicle body is mounted on the first leg of the solebar.

27. A railway vehicle according to claim 26, wherein the lower sidewall comprises an overlapping lower sidewall portion coupled to the first leg in an overlapping manner and a parallel lower sidewall portion extending beyond the end of the first leg at the same angle of inclination as the first leg.

28. A railway vehicle according to claim 20, comprising a second solebar arranged to form a second underframe side member that extends parallel to the first solebar, whereby the second solebar has an obtuse L-shaped cross-sectional profile.

29. A solebar according to claim 6, wherein the solebar sections are coupled together using any of a coupler and a weld.

30. A solebar according to claim 16, wherein the coupling is provided by any of a coupler and a weld.

* * * * *